United States Patent [101]

Cooper

[11] 4,054,700

[45] Oct. 18, 1977

[54] CARPET FITTINGS

[75] Inventor: Michael Francis Anthony Cooper, Kidderminster, England

[73] Assignee: Cobra Metals Limited, England

[21] Appl. No.: 602,390

[22] Filed: Aug. 6, 1975

[30] Foreign Application Priority Data

Aug. 9, 1974 United Kingdom ..... 35157/74
Mar. 27, 1975 United Kingdom ..... 13119/75

[51] Int. Cl.[2] ..... A47G 27/04

[52] U.S. Cl. ..... 428/90; 16/4; 16/7; 16/8; 16/16; 148/6.27; 427/206; 428/52; 428/62; 428/82; 428/457

[58] Field of Search ..... 16/4, 7, 8, 16; 148/6.27; 428/90, 82, 52, 62, 457; 427/206

[56] References Cited

U.S. PATENT DOCUMENTS

| | | | |
|---|---|---|---|
| 924,355 | 6/1909 | Howard | 16/4 |
| 1,556,233 | 10/1925 | Maise | 16/4 |
| 1,896,823 | 2/1933 | Upham | 16/8 |
| 2,794,757 | 6/1957 | Bright | 16/16 X |
| 2,926,378 | 3/1960 | Eichhorn et al. | 16/4 |
| 3,077,429 | 2/1963 | Carrigan | 428/62 |
| 3,158,893 | 12/1964 | Smith | 16/4 |
| 3,401,075 | 9/1968 | Jackson | 428/90 |
| 3,502,207 | 3/1970 | Alexander | 427/206 |

FOREIGN PATENT DOCUMENTS

| | | |
|---|---|---|
| 1,207,953 | 10/1970 | United Kingdom |

*Primary Examiner*—Ralph S. Kendall
*Assistant Examiner*—John D. Smith
*Attorney, Agent, or Firm*—Imirie & Smiley

[57] ABSTRACT

A carpet fitting, such as a cover strip, threshold guard, edging piece, threshold strip or joining strip of which, in use, a surface is exposed to view. Such exposed surface is coated with flock by electrostatic deposition. Further surface areas may be so coated. The flock may be selected to blend with the carpet and the flock coating assists in preventing persons from slipping on the fitting.

1 Claim, No Drawings

CARPET FITTINGS

BACKGROUND OF THE INVENTION

This invention concerns improvements in or relating to carpet fittings of the kind herein defined as including cover strips, edging pieces, threshold strips and joining strips, and of the kind with or without teeth or other means for securing the carpet or other similar floor covering thereto.

It is known to provide such kind of carpet fittings where made of metal in a polished, bright, or other decorative finish. However, these fittings are distinctive in appearance and are readily observed by the eye.

An object of this invention is to providea carpet fitting which may be unobtrusive to the eye.

It is also found that the known metal carpet fittings are formed to have an exposed surface in use which is smooth and/or slippery. A further object of this invention is to provide a carpet fitting which reduces the risk of persons slipping thereon.

SUMMARY OF THE INVENTION

According to this invention we provide a carpet fitting of the kind defined having a body of which at least the surface which is exposed to view in use is coated with flock by electrostatic deposition.

The flock comprises cut or ground fibers which are adhesively secured or bonded to the body to form a surface covering in the form of a pile. Preferably the body comprises a metal extrusion such as aluminum.

With the present invention the flock coating gives a matt, non-reflective finish to the exposed surface of the fitting and thus the fitting is less obtrusive than a polished or bright metal surface Preferably the flock is colored. Accordingly, the invented carpet fitting may be colored to match the colour or a predominant color of the carpet or floor covering with which it is to be used. Conveniently a whole range of color may be available for selection by the user.

DETAILED DESCRIPTION OF THE INVENTION

In a preferred method for producing a carpet fitting according to this invention, the fitting comprises a metal body in the form of an aluminum alloy extrusion. The aluminum strip is treated to remove surface grease and other contaminents either by trichloroethylene or alkali cleaning.

The aluminum strip is then subjected to a surface treatment, normally referred to as conversion coating in which the aluminum substrate is chemically changed to an amorphous oxyphosphate. This treatment comprises dipping the strip into an acidic aqueous solution of chemicals selected to convert the aluminium and/or aluminum oxide to such oxyphosphate. The coating provides a sealed surface which is oxidization resistant. (One proprietory form of treatment is that of Amchem Products Inc. sold under the Registered Trade Mark ALOCROM).

The treated aluminium strip may then be further cleaned by water rinsing and drying.

A bonding agent for adhesively securing flock to the body is then applied to the clean converted surface to be coated with flock. The bonding agent may comprise an epoxy resin of the two part type comprising an adhesive and a hardener which are mixed together. The mixture may also include an accelerator, and, if desired, a color pigment. A suitable bonding agent is Araldite (Registered Trade Mark).

The treated metal strip is then passed through a flocking depositing plant of the electrostatic type in which there is a very high voltage electrostatic field and in which the flock to be applied is of the particular type and color desired. After the flock has been deposited the bonding agent is allowed to set and/or dry. The set and/or dry time may be shortened by subjecting the strip to infra-red heating. Surplus flock may then be removed by tapping the fitting or blowing air over same. Alternatively the surplus flock may be removed by passing the coated strip through a brush vacuum chamber The aluminum strip may be of any suitable configuration for the purpose of intended use. Other metals such as steel, or material such as plastic or plastic with metal reinforcement may be employed.

As exemplary embodiments, the strip may be of opposed channel section like an H-section with the flock applied to an outer face of one leg arranged to be uppermost in use of the fitting. As a further example, the strip may be of J-section with the outer face of the curved portion coated with flock. A further example is a carpet fitting having a base section for securing the carpet or the like, and a trim section adapted for fastening or securing to the base section. The trim section may be flock coated as aforedescribed.

It is further envisaged that for ease of manufacture and flock coating, the entire outer face of a carpet fitting may be coated.

I claim

1. A carpet fitting comprising a body in the form of an aluminum alloy extrusion having a surface which is exposed to view when said fitting is in use, a conversion layer of amorphous oxyphosphate on said exposed surface of said body, a coating on at least said conversion layer of said exposed surface, and said coating comprising an electrostatically deposited flock of fiber strands and a hardenable epoxy resin directly bonding said strands to said coated body to form a pile thereon.

* * * * *